US010926932B2

(12) United States Patent
Bazin

(10) Patent No.: US 10,926,932 B2
(45) Date of Patent: Feb. 23, 2021

(54) 3D FLEXIBLE BAG TO BE FILLED FOR BIOPHARMACEUTICAL FLUIDS AND METHOD FOR CREATING SUCH A BAG

(71) Applicant: SARTORIUS STEDIM FMT SAS, Aubagne (FR)

(72) Inventor: Frédéric Bazin, Cassis (FR)

(73) Assignee: SARTORIUS STEDIM FMT SAS, Aubagne (FR)

( * ) Notice: Subject to any disclaimer, the term of this patent is extended or adjusted under 35 U.S.C. 154(b) by 28 days.

(21) Appl. No.: 16/313,553

(22) PCT Filed: Jul. 4, 2017

(86) PCT No.: PCT/FR2017/000136
§ 371 (c)(1),
(2) Date: Dec. 27, 2018

(87) PCT Pub. No.: WO2018/007691
PCT Pub. Date: Jan. 11, 2018

(65) Prior Publication Data

US 2019/0256270 A1 Aug. 22, 2019

(30) Foreign Application Priority Data

Jul. 8, 2016 (FR) ..... 1670374

(51) Int. Cl.
*B65D 77/06* (2006.01)
*A61J 1/10* (2006.01)
(Continued)

(52) U.S. Cl.
CPC ..... *B65D 77/065* (2013.01); *A61J 1/10* (2013.01); *A61J 1/1475* (2013.01); *B65D 31/10* (2013.01)

(58) Field of Classification Search
CPC ..... B65D 31/10; B65D 77/065; B31B 2155/001; B31B 2155/0012;
(Continued)

(56) References Cited

U.S. PATENT DOCUMENTS 5,547,284 A * 8/1996 Imer ..... B65D 75/5866 383/104
5,988,422 A * 11/1999 Vallot ..... A61J 1/05 220/62.22
(Continued)

FOREIGN PATENT DOCUMENTS

CN 1505581 A 6/2004
CN 102844245 B 8/2014
(Continued)

OTHER PUBLICATIONS

Search Report for European patent application No. 17 740 426.6-1017 dated Oct. 3, 2020.
(Continued)

*Primary Examiner* — Thomas M Wittenschlaeger
(74) *Attorney, Agent, or Firm* — Heslin Rothenberg Farley & Mesiti P.C.; Victor A. Cardona, Esq.

(57) ABSTRACT

A 3-D flexible bag to be filled with a biopharmaceutical product is formed by assembling of two wall elements and two gussets. At least one connection port is provided, for filling and/or emptying. A substantially parallelepipedal configuration is obtained in a filled state thanks to the unfolding of the gussets combined with the folding of flaps of the two wall elements. A transverse weld, formed at one end, connects the two wall elements of the bag and extends continuously, keeping in a folded-flat state: an elongate edge portion of one gusset; an elongate edge portion of the other
(Continued)

gusset. This transverse weld has a length corresponding to a determined dimension of the flexible bag in the parallelepipedal configuration.

4 Claims, 6 Drawing Sheets

(51) Int. Cl.
*A61J 1/14* (2006.01)
*B65D 30/20* (2006.01)

(58) Field of Classification Search
CPC ..... B31B 2155/0014; B31B 2155/002; B31B 2155/003; A61J 1/1475; A61J 1/10
See application file for complete search history.

(56) References Cited

U.S. PATENT DOCUMENTS

| | | | | |
|---|---|---|---|---|
| 6,092,933 | A * | 7/2000 | Treu | B65D 75/008 383/104 |
| 6,126,315 | A * | 10/2000 | Ichikawa | B65D 31/10 383/43 |
| 6,332,711 | B1 * | 12/2001 | Inuzuka | B65D 31/02 383/104 |
| 6,371,646 | B1 * | 4/2002 | LaFleur | B29C 66/004 383/109 |
| 6,425,847 | B1 * | 7/2002 | Broenstrup | B31B 70/00 493/186 |
| 6,517,660 | B2 * | 2/2003 | Ausnit | B31B 70/00 156/269 |
| 6,527,445 | B2 * | 3/2003 | LaFleur | B65D 88/1618 383/120 |
| 8,579,779 | B2 * | 11/2013 | Totani | B65D 31/08 493/189 |
| 8,777,826 | B2 * | 7/2014 | Totani | B31B 37/00 493/193 |
| 9,126,383 | B2 * | 9/2015 | Yeager | B65D 31/10 |
| 9,346,612 | B2 * | 5/2016 | Plunkett | B65D 88/1618 |
| 9,688,441 | B2 * | 6/2017 | Koesters | B65D 33/06 |
| 10,493,715 | B2 * | 12/2019 | Totani | B31B 70/18 |
| 2007/0237433 | A1 | 10/2007 | Plunkett et al. | |
| 2011/0000918 | A1 * | 1/2011 | Plunkett | B65D 77/06 220/495.06 |
| 2012/0028039 | A1 | 2/2012 | Klenke | |
| 2018/0370173 | A1 * | 12/2018 | Garriga Jimenez | B31B 70/00 |

FOREIGN PATENT DOCUMENTS

| | | | |
|---|---|---|---|
| CN | 104995027 | B | 6/2018 |
| DE | 202007008772 | U1 | 10/2008 |
| EP | 0326730 | A1 | 2/1988 |
| EP | 1277666 | A1 | 1/2003 |
| FR | 2781202 | A1 | 1/2000 |
| WO | 0004131 | A1 | 1/2000 |
| WO | 2002085726 | A1 | 10/2002 |
| WO | 2007112383 | A1 | 10/2007 |
| WO | 2015118269 | A1 | 8/2015 |

OTHER PUBLICATIONS

International Preliminary Report on Patentability (and English Translation) for International Application No. PCT/FR2017/000136 dated Jan. 8, 2019.
Preliminary Search Report for French Priority Application No. 1670374 dated Dec. 19, 2016.
English translation of China National Intellectual Property Notification of First Office Action dated Jul. 16, 2019 and Search Report for Application No. 201780041852.7.
International Search Report (and English translation) and Written Opinion of the International Searching Authority for PCT/FR2017/000136 dated Sep. 20, 2017.
India Examination Report dated May 20, 2020.

* cited by examiner

3D FLEXIBLE BAG TO BE FILLED FOR BIOPHARMACEUTICAL FLUIDS AND METHOD FOR CREATING SUCH A BAG

CROSS REFERENCE TO RELATED APPLICATIONS

This application is a national stage filing under section 371 of International Application No. PCT/FR2017/000136, filed on Jul. 4, 2017, published on Jan. 11, 2018 as WO 2018/007691 A1 which claims priority to French Patent Application No. 1670374, filed on Jul. 8, 2016. The entire disclosure of each application is hereby incorporated herein by reference.

BACKGROUND

The invention relates to the field of packaging biopharmaceutical fluids and relates, more particularly, to a flexible reservoir to be filled, in the form of a 3-D (three-dimensional) flexible bag, which must generally be placed in a rigid container. The invention also relates to an item of equipment and a method for producing such a 3-D flexible bag.

The meaning of "biopharmaceutical product", is a product coming from biotechnology, culture mediums, cell cultures, buffer solutions, artificial nutrition liquids, blood products and derivatives of blood products, or a pharmaceutical product or more generally, a product configured to be used in the medical field. Such a product is in liquid, pasty, or possibly powder form. The invention is also applied to the filling of flexible bags with other products but subjected to similar requirements concerning the packaging thereof.

In 3-D bags of this type, single-use and configured to receive a biopharmaceutical product (of international class A61J 1/05 according to the international or cooperative classification), the volume is typically delimited by a lower end wall, an upper end wall and a flexible lateral wall, which could be located in two extreme states—folded-flat and expanded—unfolded. The 3-D bag can be deformed to pass from either of these states or be in a whole intermediate state. The walls of the bag, composed of a single-layer or multilayer film, made of plastic material such as polyethylene or a complex comprising polyethylene, delimit an inner space which, in folded state, is of minimum volume and, in unfolded and expanded state, is maximum. This space is configured to receive the biopharmaceutical product for storage, processing and transportation. Such a flexible bag, biocompatible, single-use, can be of significant volume or 2 or 5 liters at least, up to 3000 liters, possibly even more, which justifies 3-D being qualified. Such a bag thus offers a significant capacity, while being able to be easily stored. An example of such a bag is described in international application WO00/04131 or in document FR 2781202. Contrary to the bags of which only the bottom has a gusset (with an increased risk of breaks), it is preferable to create two opposite gussets, illustrated in FIGS. 3 to 5 of document WO00/04131. The welds at the top and at the bottom of the bag are made of K, before proceeding with a cut of the portions of angles (cut to remove the outer parts of the films beyond the weld zones).

Sometimes, the closed products in this type of bag are used thousands of kilometers away from the place where the bag has been filled. These products are often of a high financial value, even often of a high value for the health of individuals since they can be used, for example, for producing medication configured for human health. It is therefore essential that these bags safely reach their destination, full of liquid with which they have been filled at the start, and not contaminated.

In certain options, the bag can also comprise sensors (temperature, pH, physico-chemical characterization of the biomass) and/or a processing member, for example in the form of a mixer that can be actuated by mechanical or mobile coupling by magnetic drive.

Regarding numerous stresses to which these bags are subjected, in particular during the transportation thereof or during certain processing of the biopharmaceutical product: accelerations, braking, tossing, shocks, vibrations, etc. (i.e. numerous forces of which the shear forces which tend to alter the film which constitute them, in particular in sensitive places like folds), it is essential to form the connection port(s), being used in particular for the filling or emptying, in a portion of the bag which is separated from the weld zones. Furthermore, these connection ports are the only ports with access to the inner space, the bags having no hinged or removable cover, opening/closing flap, peelable or tearable portion, and no fragile zones. The bags have no weak zones in the weld zones.

It can be provided, that the bag is provided with an port for entering or introducing a biopharmaceutical product and a port for creating gas, for example on the side of an upper end wall. Corresponding supply ducts, each connected to a supply source (which is generally external to the rigid container being used to transport and store the 3-D bag in a folded state), are connected to these respective ports. Alternatively, the filling can be done by using a lower supply line. Document EP-B1-0326730 describes a filling of this type with the disadvantage that the flexible bag is more complex, this being provided with side panels, which limits the interest of this option type. It is generally desirable to limit the complexity and the cost of the 3-D flexible bag which is a single-use consumable (here, it is a flexible bag without the possible accessories).

The K-shaped weld is applied also for bags for medical or medicinal use (also single-use) which have a large upper opening in a parallelepipedal expanded configuration, as described in particular in U.S. Pat. No. 6,332,711 B1. In this case, it is preferably to provide a lower connection port for the emptying.

In practice, it is desirable that the flexible bag can be expanded without undesirable folding which limits the actual folding volume. Indeed, filling generally requires a human monitoring, because of the expansion defects, in particular connected to the flexibility of the bag and to the mobility of the supply ducts. The loading system described in document WO 2015/118269 makes it possible for guiding, to avoid the undesirable appearance of folds, but this requires a specific implementation.

There is therefore a need for a 3-D bag, robust and suitable for the conservation, processing, and/or transportation of biopharmaceutical fluid (of volume of 50 liters and more), which remains sufficiently simple to product and limiting the risk of undesirable folding in the filling phases.

SUMMARY OF THE INVENTION

According to a first aspect, the invention aims for a 3-D flexible bag (with gussets) for a biopharmaceutical product, provided with at least one connection port for the filling and/or the emptying, and designed to be expanded from a flat, empty configuration to a substantially parallelepipedal configuration in a folded state.

The 3-D flexible bag has:

a first wall element consisting of a film and making it possible to define a front face, a second wall element consisting of a film and making it possible to define a rear face, a first gusset and a second gusset, each connected to two side edges of either of the first and second wall elements, the first gusset and the second gusset being constituted by respective films, cut from a part and each likely to be folded, typically in two, along a folding line towards the inside, which extends between two opposite ends of the flexible bag, and the at least one connection port, formed exclusively in one from among the first wall element and the second wall element, the first wall element and the second wall element being welded to one another along a direction called transverse, to one at least of the two opposite ends.

In this bag, the first wall element and the second wall element have, along said transverse direction, a determined dimension (typically the width) which is, at least in the flat configuration, substantially the same:

in the front and rear faces, and to one at least of the two opposite ends, where a continuous weld extends over the whole of the determined dimension, knowing that the continuous weld further makes it possible, in one same end of the bag, to keep in a folded-flat state, an edge portion (elongate portion) of the second gusset, both in the flat configuration and in the parallelepipedal configuration. The folded-flat state typically corresponds to a non-modifiable configuration wherein each edge portion covered by wall elements is kept folded in two.

Thanks to these arrangements, the bag has a sufficiently long and rigid welded end, to both:

guide a correct unfolding of the first and second gussets, as well as a correct folding of the first and second wall elements to reduce the initial distance between the two opposite ends;

reduce the risk of breaking at the connection end where all the films are joined, constituting the bag.

On the side of this end, a face can be formed which is thus more robust than when a K-shaped weld is done. The design method can further be simplified by limiting to four, the joining angles between two straight-lined welds, the welds being done while the first and second wall elements of the bag are kept parallel to one another.

According to a particularity, in the flat configuration, the two folding lines are separated by a transverse space which is less than one half, and preferably less than one quarter, of the determined dimension.

According to a particularity, in the flat configuration of the 3-D flexible bag, the folding line of each gusset is straight-lined, and the continuous weld is transverse (typically perpendicular) to each straight-lined folding line of the gussets.

According to a particularity, the flexible bag is provided with at least one connection port placed in a flap defined by the first wall element, on the side of the continuous weld and with a clearance with respect to this weld. Thus, it is made possible to introduce a biopharmaceutical liquid or to empty such a liquid on the side of an elongate welded edge. For emptying in particular, it is observed that the gussets further keep the orientation thereof, which encourages the smooth functioning of the emptying. Indeed, the junction type between the gussets and the first and second wall elements, with such an elongate welded edge, significantly limit the risk of fold formation (in particular, folding through, with respect to the folding line, predefined for each gusset) which shows the residual volumes of biopharmaceutical product retention.

For filling in a rigid container, this configuration can also contribute to limiting the expansion defects connected to the flexibility of the bag. Thus, it has been observed with bags without such an elongate welded edge as the flexible bag, because of significant folds, is blocked against the inner faces of the axial wall of the rigid container, leading to an unfolding defect, and the risks of damaging the flexible, single-use bag.

In various embodiments of the flexible bag, one or more of the following arrangements can furthermore possibly be resorted to:

two first flaps are provided, one of which forms part of the first wall element and the other forms part of the second wall element, the two first flaps being joined and forming:

an outer face of the flexible bag in the parallelepipedal configuration;

a first protruding strip which extends parallel to the front face and to the rear face, provided with a substantially straight-lined free edge, the first protruding strip protruding from said outer face of the flexible bag, in the parallelepipedal configuration, the continuous weld rigidifying the whole of the first protruding strip.

two second flaps are provided, one of which forms part of the first wall element and the other forms part of the second wall element, the two second flats being joined by forming a second protruding strip opposite the first protruding strip and provided with a substantially straight-lined free edge.

the second protruding strap protrudes from another outer face of the flexible bag, the other outer face being defined by the second flaps in the parallelepipedal configuration, by extending parallel to the front face and to the rear face.

at least one from among the first protruding strip and the second protruding strip:

has a central weld portion done directly between an inner face of the first wall element and an inner face of the second wall element; and is further rigidified on either side of the central weld portion, in the portions longer than the central weld portion, and preferably at least twice as long.

the first protruding strip and the second protruding strip have an identical length and each flap from among the two first flaps and the two second flaps is delimited by a U-shaped weld zone defining two right angles in the flat configuration.

each U-shaped weld zone is designed and arranged to prevent, whatever the filling proportion of the flexible bag:

an unfolding of a first triangular portion belonging to the first gusset and adjacent to an edge portion of the first gusset folded in two;

an unfolding of a second triangular portion belonging to the second gusset and adjacent to an edge portion of the second gusset folded in two.

the first triangular portion and the second triangular portion extend substantially in one same plane along a flap selected from among one of the two first flaps and the two second flaps.

the first gusset is delimited by two first longitudinal edges which extend from one to the other of the two opposite ends of the flexible bag, while the second gusset is delimited by two second longitudinal edges which extend from one to the other of the two opposite ends.

the two first longitudinal edges are continuously welded and are each U-shaped in the parallelepipedal configuration, by rectangularly delimiting a first face of the flexible bag which is defined by the first gusset in the parallelepipedal configuration.

the two second longitudinal edges are continuously welded and are each U-shaped in the parallelepipedal configuration, by rectangularly delimiting a second face of the flexible bag which is defined by the second gusset in the parallelepipedal configuration.

the determined dimension is identical in the front face, the rear face and each of said flaps, such that the two first flaps and the two second flaps themselves form two rectangular opposite faces of the flexible bag in the parallelepipedal configuration and partially covering the first and second gussets.

the films respectively constituting the first wall element, the second wall element, the first gusset and second gusset are welded by defining together in the flat configuration, a total of six welds, of which:

two continuous welds formed at the two opposite ends and which extend along the transverse direction; and four side welds, perpendicular to the transverse direction.

each of the six welds is continuous and of a width at least equal to 5 mm.

each of the films respectively constituting the first wall element, the second wall element, the first gusset and the second gusset locally has, along the welds, a thickness which is not less than the average thickness of the films, the average thickness being between 150 and 450 μm for each of these films.

the following ratio is satisfied:

$$0.05<D2/L2<0.5$$

where L2 means the determined dimension; and

D2 means a transverse space between the first gusset and the second gusset, measured along said transverse direction.

the respective films are each composed of at least three plastic, non-metal layers, and are preferably transparent or translucid.

the respective films each have a thickness of between 150 micrometers and 450 micrometers and a resistance to traction of between 60 and 220 Newtons.

the first gusset and the second gusset each have:

an inner, hot-weldable layer, made of a material selected from among polyethylene, ethylene vinyl acetate copolymer; and an outer weldable layer, made of a material selected from among polyethylene, polyamide, ethylene vinyl acetate copolymer, polyamide and poly(ethylene terephthalate).

in the parallelepipedal configuration:

the maximum extension of each of the first and second gussets is at least 15 cm between the first wall element and the second wall element.

the flexible bag makes it possible to delimit an inner space at least equal to 2 L, preferably at least equal to 5 L.

According to a second aspect, a method for producing a 3-D flexible bag according to the invention to be filled by a biopharmaceutical product is proposed, method wherein the following occur along a longitudinal scrolling direction and the following are cut transversally:

a first wall element provided with two side edges consisting of a film and making it possible to define a front face, a second wall element provided with two side edges, consisting of a film and making it possible to define a rear face, a first gusset and a second gusset, each constituted by a film cut from a part and delimited by two longitudinal edges, knowing that each from among the first gusset and the second gusset is inserted, in a folded-in-two state around a longitudinal folding line, between the first wall element and the second wall element, the first gusset and the second gusset being arranged with a transverse space against one another.

This method more specifically comprises the steps which essentially consist of:

longitudinally welding the two longitudinal edges of the first gusset to the first wall element and to the second wall element, respectively to one of the side edges of the first wall element and of the second wall element, this, thanks to which two first side welds are obtained;

longitudinally welding the two longitudinal edges of the second gusset to the first wall element and to the second wall element, respectively to the other of the side edges of the first wall element and of the second wall element, this thanks to which two second side welds are obtained;

transversally welding the first wall element and the second wall element to form a welded end rim, and preferably two opposite welded end rims, by sandwiching between the first wall element and the second wall element, respectively two layers of the first gusset folded in two and two layers of the second gusset folded in two, such that the first gusset and the second gusset are also welded in an end rim, and preferably two opposite end rims, perpendicularly to the longitudinal edges thereof in a flat, empty configuration of the flexible bag (the first and second wall elements thus being kept parallel), each longitudinal folding line extending between two opposite ends of the flexible bag in the flat configuration, such that the first gusset and the second gusset make it possible for the bag to be expanded from the flat, empty configuration to a substantially parallelepipedal configuration in a filled state, each end edge being continuously welded and defining an outer determined dimension of the bag which is common to the rear face and to the front face in the parallelepipedal configuration;

inserting, exclusively in one from among the first film and the second film, a connection port making it possible to connect a flexible supply duct.

According to a particularity, it is provided to weld two opposite end rims, parallel, in order to define the same outer determined dimension (L2) of the flexible bags at these ends, the first wall element and the second wall element having a rectangular perimeter in the flat configuration.

According to a preferred option, the first wall element, the second wall element, the first gusset and the second gusset are defined by rectangular sheets having one same multilayer structure.

BRIEF DESCRIPTION OF THE DRAWINGS

Other characteristics and advantages of the invention will appear during the following description of several embodiments, given as non-limiting examples facing the appended drawings wherein.

Below, a detailed description of several embodiments of the invention matched with examples and in reference to the drawings.

DETAILED DESCRIPTION

In the different figures, identical references indicate identical or similar elements.

Figure 1A:
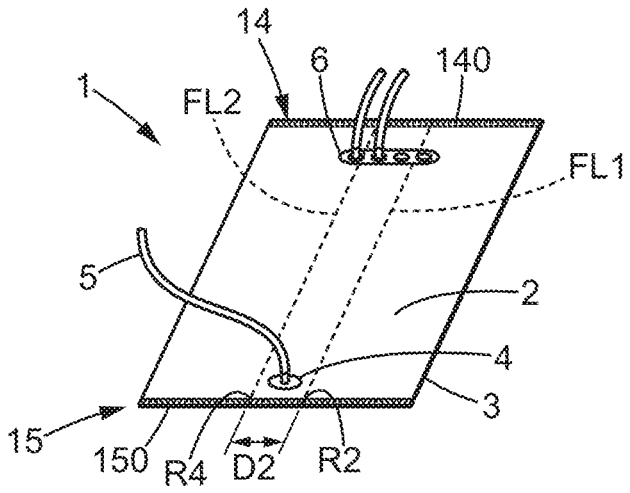
FIGS. 1A and 1B are perspective views representing, according to a first embodiment, a 3-D flexible bag before a filling with a biopharmaceutical fluid.
Figure 1B:
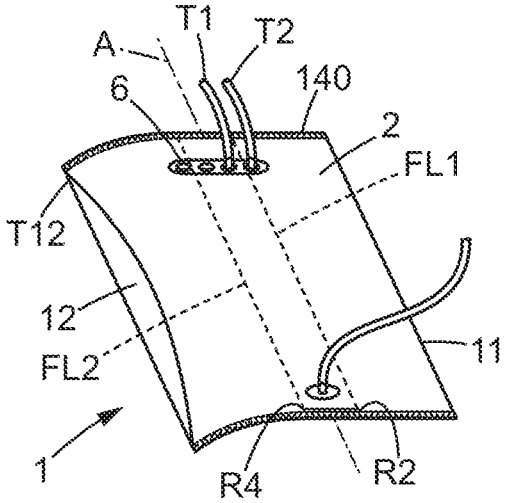
Figure 2:
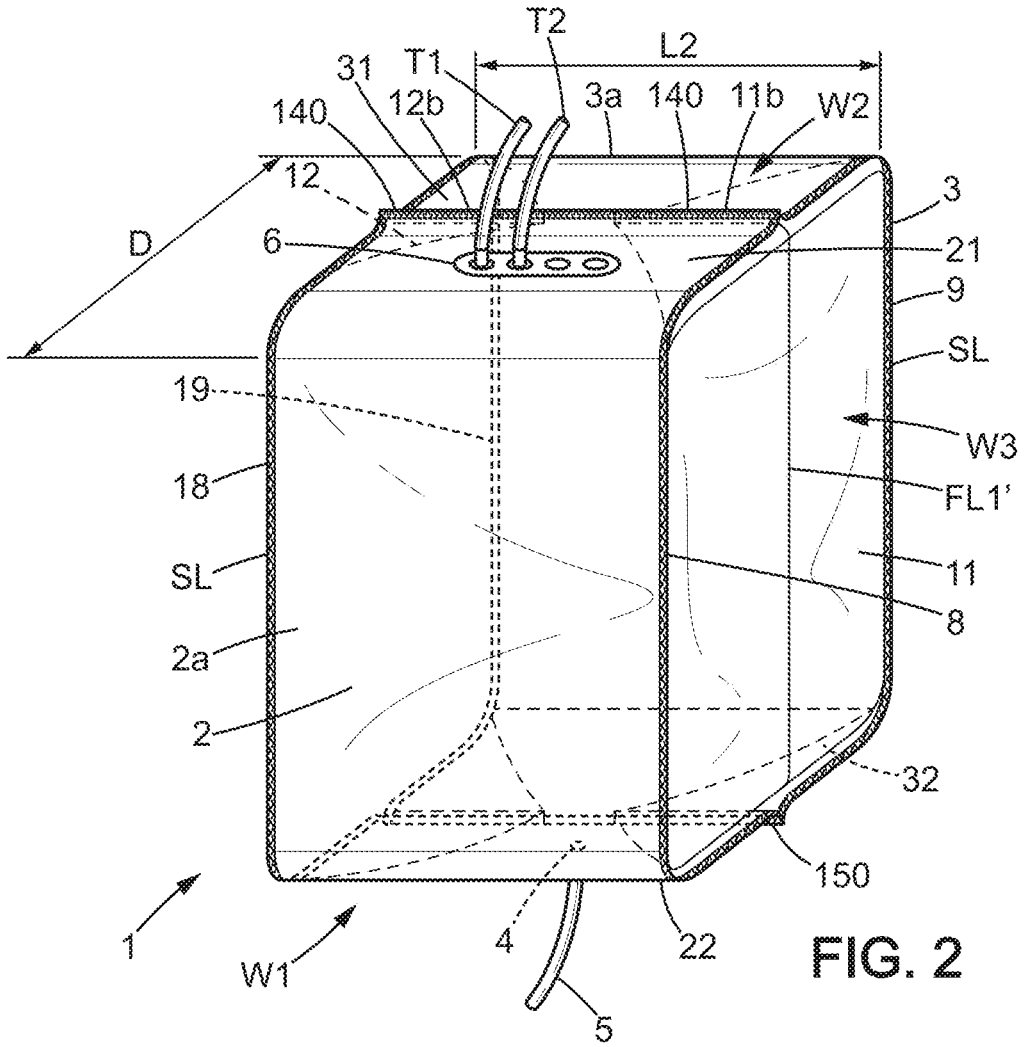
FIG. 2 is a perspective view of the 3-D flexible bag of FIGS. 1A-1B, in the expanded state and filled with a biopharmaceutical fluid.

As can be seen in FIGS. 1A and 1B, the flexible bag 1 which is expanded in three dimensions can have a flat configuration, wherein two opposite wall elements 2, 3 define two main opposite outer faces of the flexible bag 1. It can be seen, that this flexible bag 1 has connection ports for filling and/or emptying. Here, the connection port 4 can make it possible to connect, according to a non-limiting example, a flexible pipe 5 to empty the bag. In this case, and as illustrated in FIG. 2, when the flexible bag 1 is in a parallelepipedal expanded configuration, this connection port 4 of the flexible bag 1 of 3-D type, extends into a first end face W1. According to an option, one or more connectors 6 forming connection ports are provided here on the second end face W2, opposite the connection port 4, to make it possible to fill the flexible bag 1 (with typically several inlet or supply openings). Generally, at least one flexible supply duct is provided to make it possible to fill the 3-D flexible bag, via a connection port. Here, the flexible pipes T1, T2 connected to the connectors 6 are of a type known per se. The flexible lateral wall W3 has predefined folds, in particular folding lines FL1 and FL2, formed in the gussets 11, 12 during the design of the flexible bag 1, which facilitates a correct unfolding as the filling level, typically with a biopharmaceutical fluid, increases.

Of course, the position of the connection port(s) 4, 6 can vary, preferably by making openings on one (preferably only one) of the wall elements 2 and 3. These connection ports 4, 6 are placed at a distance from the connection zones between the two wall elements 2 and 3, and they do not interfere with the unfolding of the gussets 11 and 12 of the flexible bag 1, of 3-D type. The ports 4, 6 can be closed sealed in a manner known per se (in the example of FIG. 10, the ports are connected sealed to a tube length or pipe T1, T2 itself blocked, sealed, by a clip generally called "clamp" (C1, C2) by a person skilled in the art, a aseptic connector, or could include one-way dampers or valves or other similar sealed closing systems).

Figure 3:
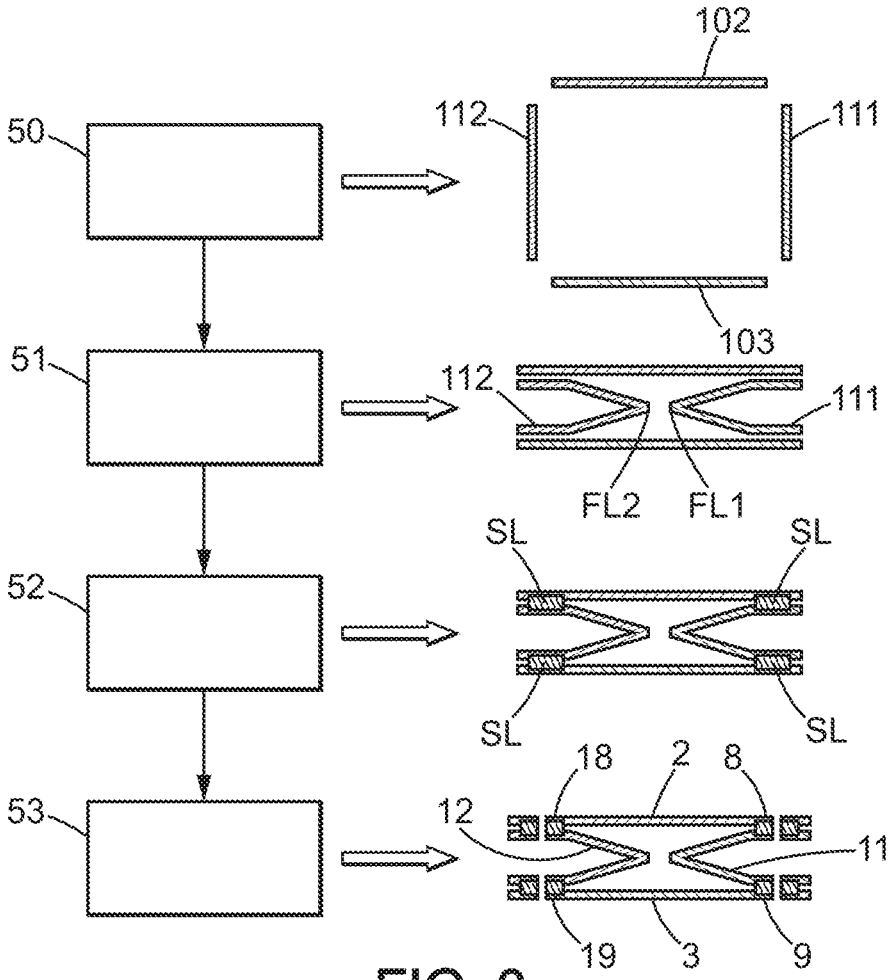
FIG. 3 shows a flowchart of steps represent the steps of assembly and trimming four films constituting the 3-D flexible bag.
Figure 7:
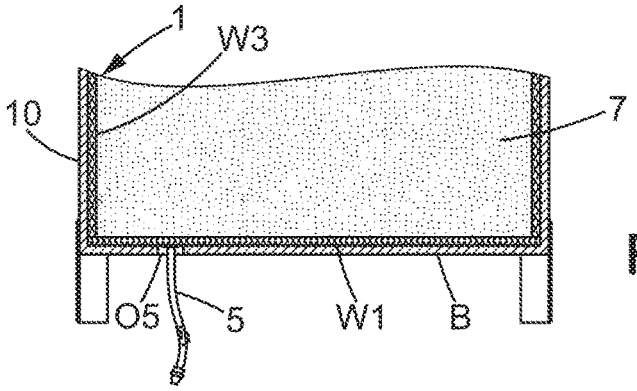
FIG. 7 is a side view showing the bottom of a 3-D flexible bag in a filled state and received in a storage device.

FIG. 7 illustrates an example of application of the flexible bag 1. Here, the bottom defined by the first end face W1 is coupled with the base part B of a storage device 10, which could make it possible, if necessary, to transport the flexible bag 1, of 3-D type, to the filled state. The flexible pipe 5 to achieve an emptying is thus capable of passing through an orifice O5 situated in the base part B of the storage device 10. This cooperation with an orifice O5 makes it possible to correctly position the first end face W1 of the flexible bag 1. In addition, the disappearance of the welds forming a K on the sides, removed the stresses connected to the incorrect positioning of these welds with respect to the storage device 10, which could start a leak. In practice, the flexible bag 1 can be placed in the inner volume of such a storage device 10 before a step of filling with biopharmaceutical fluid. The inner volume of the device 10 is accessible by an upper transverse opening, and possible accessible using side doors. FIGS. 1 and 3 of document WO 2015/118269 illustrate this type of storage device.

Increasing volume of the flexible bag 1 can be done by minimizing the risk of forming an incorrect fold in the face W1. The lateral wall W3 can also swell with no obstacle and with no incorrect fold to pass from an extreme state (completely flat) to another extreme state (by defining a parallelepipedal volume), by resting on the inner face of the storage device 10. This type of storage device 10 can be presented in the form of a rigid container, possibly with a stacking possibility.

It is, in the case of FIG. 7, an application for large volumes which reach or exceed 15 or 20 liters. This is why it is, in practice, necessary to ensure the outer holding of the flexible bag 1, once filled with content. Certain rigid containers are also used for transportation, while others are more specifically suited for making it possible for them to be weighed. Holding a flexible bag 1, of 3-D type, by the outside, in a rigid receiving structure and a structure kept for storage being known per se, it will not be further described here.

In the specific embodiment of FIGS. 1A-1B and 2, it is understood that the connection port(s) 4, 6 can be placed exclusively in one flap 22 or two flaps 21, 22, defined by the first wall element 2, optionally in the proximity of a continuous weld 140 of the flexible bag 1 without passing through such a weld 140. This type of configuration is suitable, in particular for placing the flexible bag 1, of 3-D type, in a storage device 10 with no side access to the inner volume.

Figure 8A:
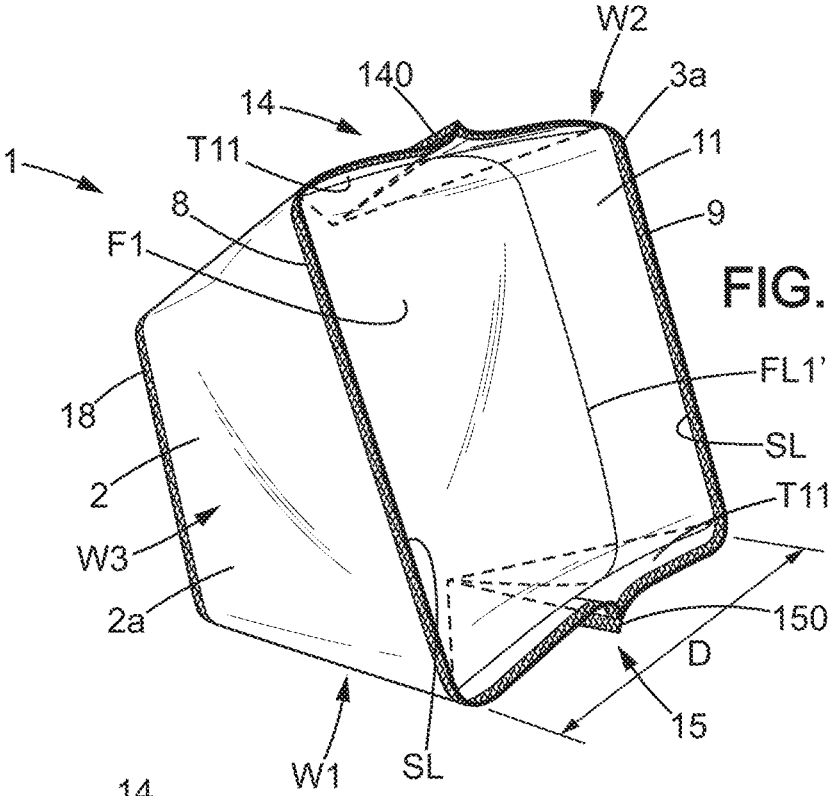
FIG. 8A is a perspective view illustrating the shaping of a first bag of the 3-D flexible bag, in the parallelepipedal configuration of the flexible bag.
Figure 9:
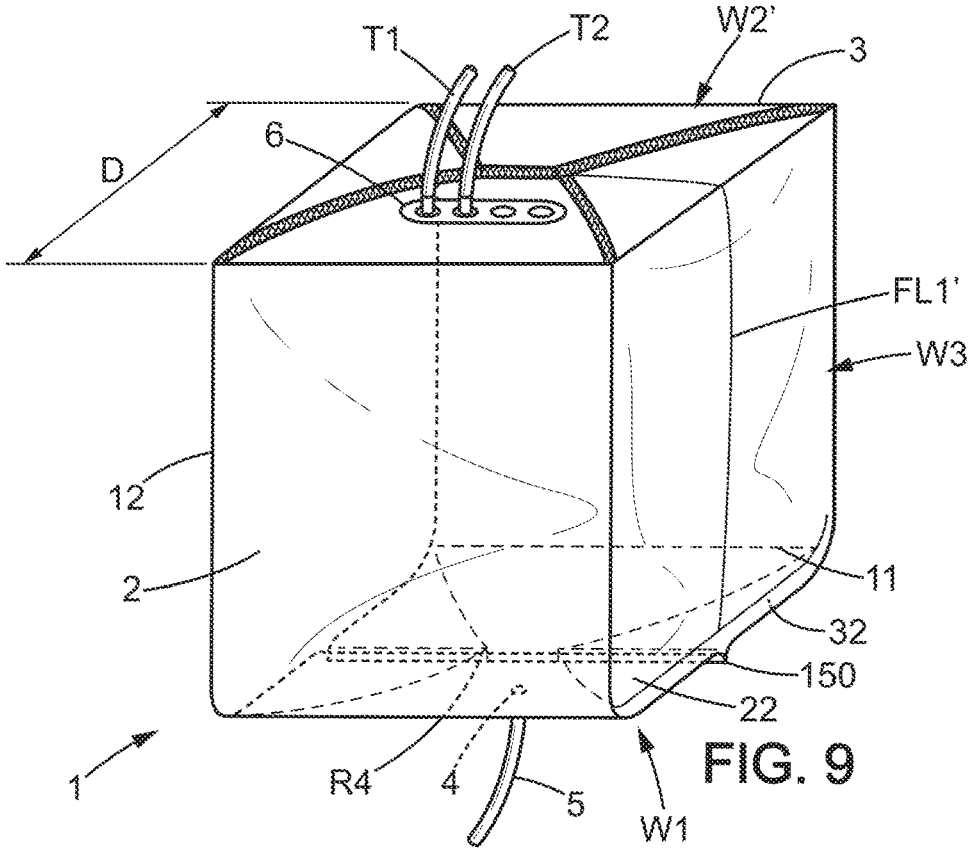
FIG. 9 is a perspective view of a 3-D flexible bag according to an embodiment variant, having a K-shaped weld at one of the ends.

In reference to FIGS. 1, 8A and 9, the maximum extension of each gusset 11, 12 caused by filling, makes it possible to move the first wall element 2 from the second wall element 3 by a distance D at least equal to 12 or 15 cm, and preferably at least equal to 40 or 50 cm for storage applications in the device 10. It is thus made possible to contain, in such a 3-D type flexible bag, a volume of biopharmaceutical product of at least 2 liters, and preferably of at least 5 liters.

Examples of functional, multilayer films making it possible to constitute the wall elements 2, 3 and the gussets 11, 12 of the flexible bag 1 are known, in particular in document US2012/028039 of the same applicant. These films make it possible to obtain a great flexibility coupled with a satisfactory resistance, which facilitates the unfolding of the gussets 11, 12 without risk that a swelling (during filling) in the first end face W1 or in the lateral wall W3 generates a breaking of the film.

The first wall element 2 is typically a flexible part consisting of a multilayer film and making it possible to define a front face 2*a* of the flexible bag 1, while the second wall element 3, produced similarly or identically (by a multilayer film) is a flexible part making it possible to define a rear face 3*a* of the flexible bag 1, as can be seen in FIGS. 1A, 1B and 2. The gussets 11 and 12 can have a similar material and a similar thickness (preferably identical) to what is provided for the wall elements 2 and 3. It is understood, that the gussets 11 and 12 are constituted by respective films, cut from one part, the cut could occur before, during or after the step of connection with the wall elements 2 and 3.

Advantageously for a filling with a biopharmaceutical fluid 7, the inner layer of each of the films which compose the flexible bag 1, is made of hot-weldable plastic material, which is biocompatible with the mediums transported. In a preferred embodiment, each film has a multilayer structure. This multilayer structure can be broken down, for example, into three layers which are typically non-metal, plastic layers. As a non-limiting example, the film can be transparent or translucid.

In a preferred embodiment, the first gusset 11 and the second gusset 12 each have:

- an inner, hot-weldable layer, made of a material selected from among polyethylene (preferably linear low density) and ethylene vinyl acetate copolymer; and
- an outer weldable layer, made of a material selected from among polyethylene (preferably linear low density, or possibly linear high density), polyamide, ethylene vinyl acetate copolymer, polyamide and polyethylene terephthalate.

The first wall element 2 and the second wall element can have a similar or identical structure to that of the gussets 11, 12. An intermediate layer, for example having a barrier effect (for example EVOH-based or equivalent material), can be provided in the multilayer structure of the elements 2, 3, 11, 12 delimiting the volume of the flexible bag 1. The multilayer structure can be broken down into at least three non-metal, plastic layers, and is preferably transparent or translucid.

Figure 6:
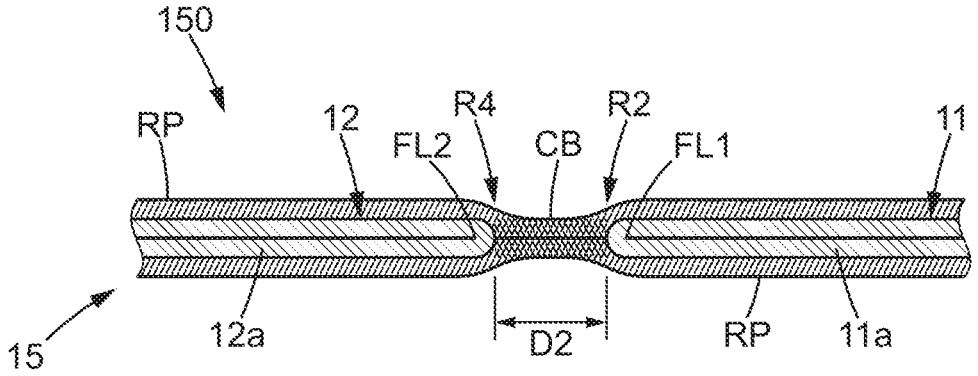
FIG. 6 is a cross-sectional view showing the arrangement of the four films in a weld in the form of a strip.

Now, in reference to FIGS. 1A and 6, it can be noted, that the gussets 11 and 12 are spaced apart from one another by a transverse space D2. This transverse space D2 corresponds to a constant distance in the flat configuration, as can be seen in FIG. 1A, in particular.

The folding lines FL1 and FL2 for the first gusset 11 and the second gusset 12 are thus straight-lined and parallel to the side edges 8, 18 and 9, 19 defined by the wall elements 2 and 3. It can be seen, that the folding lines FL1 and FL2 extend on either side of the longitudinal axis A (in this case, a central axis, as can be seen in FIG. 1B) of the flexible bag 1 in the flat configuration.

In reference to FIGS. 2 and 8A which represent the flexible bag 1 in a biopharmaceutical fluid-filled state, the first gusset 11 is connected to two side edges 8 and 9 of either of the first and second wall elements 2 and 3. Similarly, the second gusset 12 is connected to two other side edges 18 and 19 of either of the first and second wall elements 2 and 3. The connection to the side edges 8, 18 of the first wall element 2 and to the side edges 9, 19 of the second wall element 2 results from a direct weld, by thus fixing the margin zones of the gussets 11 and 12, which follow the side edges 8, 9, 18, 19. Below, these margin zones will be called longitudinal edges.

The first gusset 11 and the second gusset 12 can each be folded along the folding line FL1 and FL2 thereof, towards the inside. In this example, the folding is done in two equal halves for each gusset 11, 12, at least in the flat configuration of the flexible bag 1. Each folding line FL1, FL2 extends between two opposite ends 14, 15 of the flexible bag 1 where the gussets 11, 12 are joined.

Figure 8B:
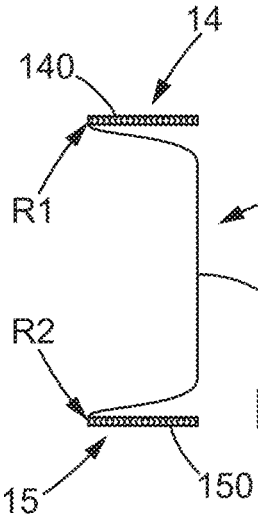
FIG. 8B is a cross-sectional view, only of the first gusset, when the 3-D flexible bag is in the same configuration as in FIG. 8A, with the folding line fully included in the cross-sectional plane.
Figure 8C:
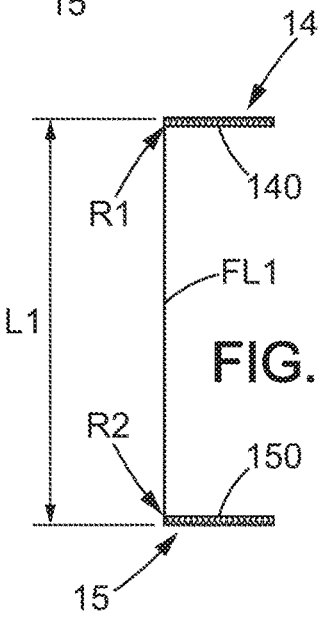
FIG. 8C is a cross-sectional view, similar to that of FIG. 8B, showing the straight-lined extension of the folding line of the first gusset when the 3-D flexible bag is in the flat configuration.

In reference to FIGS. 8B and 8C, it can be seen, that passing to the filled configuration, with a parallelepipedal geometry, is made possible by a narrowing of each gusset 11, 12 in the direction of extension of the folding line FL1 or FL2, because of the swelling towards the outside of the lateral wall W3. The section FL1', that can be seen in FIGS. 2 and 8A-8B corresponds to a segment of the folding line FL1.

The expansion, without any false fold which would limit the size of this section FL1', is obtained more easily thanks to the continuous weld which is done to hold the edge portions 11*a*, 11*b*, 12*a*, 12*b* (FIGS. 2 and 6) of the gussets 11 and 12.

In this example, a continuous weld 140 is provided on the side of the first end 14 of the flexible bag 1 and also a continuous weld 150 on the side of the second end 15 (opposite the first end 14). More generally, at one at least of the two ends 14, 15 of the flexible bag 1, the first wall element 2 and the second wall element 3 are welded to one another along a transverse direction by a continuous weld 140 and/or 150 which perpendicularly joins (in the flat configuration) the four side edges 8, 9 and 18, 19.

FIG. 6 illustrates a detail of a flexible bag 1 in flat configuration, seen from the end 15. This detail shows more specifically the continuous weld 150 which is done at this end 15. Each portion of edge portion 11*a*, 12*a* is folded in two and wedged between the corresponding ends of the first wall element 2 and of the second wall element 3. Of course, this configuration can be reproduced opposite to wedge, by a continuous weld 140, the edge portions 11*b*, 12*b* of the respective gussets 11, 12 between the other ends of the wall elements 2 and 3.

It can be provided to thus form two rims at the opposite ends 14, 15, which are welded simultaneously. In order to delimit the ends 14 and 15 of the flexible bag 1, a step of cutting before sealing the films is, for example, provided to separate two weld zones.

In reference to FIG. 2, the flexible bag 1, of 3-D type, has, for a fully expanded/filled state which corresponds to the parallelepipedal configuration:

- on the side of the first end 14, two first flaps 21, 31 of which one forms part of the first wall element 2 and the other forms part of the second wall element 3; and on the side of the second end 15, two second flaps 22, 32 of which one forms part of the first wall element 2 and the other forms part of the second wall element 3.

The first flaps 21, 31, on the one hand, and the two second flaps 22, 32 are made joining by the corresponding weld zone 140, 150. Thus, welded end rims are formed, in the form:

of a first protruding strip, at the junction of the two first flaps 21, 21; and of a second protruding strip, at the junction of the two second flaps 22, 32.

By comparing FIG. 2 to FIG. 11 which represents a 3-D flexible bag of an existing type, it can be seen, that each of the end faces W1 and W2 shown in FIG. 2 results from the formation of these rectangular flaps 21, 31 and 22, 32 belonging to the two wall elements 2 and 3. For the formation of the end face W2, which is an upper face in this example, the two first flaps 21 and 31, cover the gussets 11 and 12 by the top. These first flaps 21 and 31 of rectangular format tend to limit deformations connected to flexibility of the material constituting the flexible bag 1, of 3-D type.

More generally, at least one outer face W1, W2 of the flexible bag 1 can be formed in the parallelepipedal configuration by joining by a weld 140 or 150, two flaps 21, 31 or 22, 32, by forming a strip which protrudes towards the outside, with respect to the filled volume delimited by the flexible bag 1 (from the outer face of the bag defined by a pair of flaps 21, 31 or 22, 32).

Figure 12:
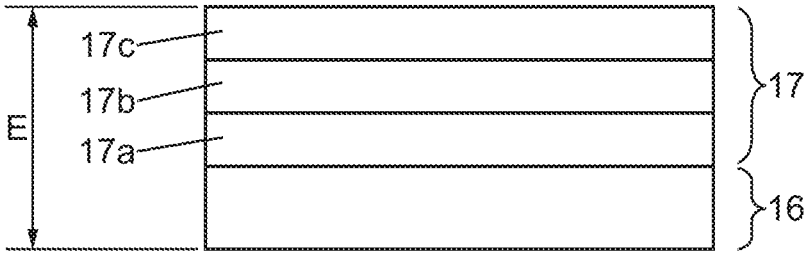
FIG. 12 represents an example of composition of films constituting the flexible bag, under the invention.

Here, in the case of FIG. 2, a first protruding strip forming the weld 140 is typically straight/straight-lined and extends parallel to the front face 2*a* and to the rear face 3*a*. This first protruding strip has a free edge, substantially straight-lined and more rigid than the non-welded parts of the bag. A second protruding strip forming the weld 150, which is typically straight/straight-lined, also extends parallel to the front face 2*a* and to the rear face 3*a*. This second protruding strip has a free edge, substantially straight-lined and more rigid than the non-welded parts of the bag. It is understood, that the protruding strip(s) have, along a cross-section, the type of configuration represented in FIG. 6. Because of this, each protruding strip has:

a maximum thickness which is four times greater than the thickness E (FIG. 12) in the flexible zones of the flexible bag 1, making it possible to make the inner volume of the bag 1 vary; and a minimum thickness which is twice greater than the thickness E in the flexible zones of the flexible bag 1, making it possible to make the inner volume of the bag 1 vary.

As can be seen in FIG. 6, each protruding strip can have a central weld portion CB made directly between an inner face of the first wall element 2 and an inner face of the second wall element. These inner faces are preferably defined by a specific layer (layer on the inner side for contact with the biopharmaceutical fluid) of a multilayer structure. The central weld portion CB has an extension (along the elongate direction of the protruding strip) which is equal to the transverse space D2 between the first gusset 11 and the second gusset 12 in the flat configuration.

The protruding strip(s) are here further rigidified on either side of the central weld portion CB, because of the increase of thickness, due to the edge portions 11*a*, 11*b*, 12*a*, 12*b*. The rigidified portions RP of each protruding strip are elongate portions, longer than the central weld portion CB (by measuring along the length of the straight strip, transversally with respect to the longitudinal scrolling direction DD), and preferably at least twice longer.

Such elongate rigidified portions RP, which are absent in conventional 3-D flexible bags (see FIG. 11) which have a K-shaped weld (welds KS in the case of FIG. 11, which require for each face W1, W2, four weld zones which are not longitudinal, nor transverse), contribute to keeping the protruding strip straight-lined and limit the risk of leakage in or at the periphery of the central weld portion CB.

In reference to FIG. 2, the welds 140 and 150 are of the same length, such that the opposite protruding strips which define the ends 14, 15 have an identical length (corresponding to the determined dimension L2, here a width).

As can be seen in FIGS. 1A-1B and 2, each flap from among the two first flaps 21, 31 and the two second flaps 22, 32 is delimited by a U-shaped weld zone defining two right angles, in particular in the flat configuration. Each U-shaped weld zone is designed and arranged to prevent, whatever the filling proportion of the flexible bag 1:

an unfolding of a first triangular portion T11 belonging to the first gusset 11 and adjacent to an edge portion 11*a*, 11*b* folded in two belonging to the first gusset 11;

an unfolding of a second triangular portion T12 belonging to the second gusset 12 and adjacent to an edge portion 12*a*, 12*b* folded in two belonging to the second gusset 12.

The first triangular portions T11 and the second triangular portions T12, which extend substantially in a plane parallel to the end faces W1, W2 in the parallelepipedal configuration, contribute to obtaining a planarity of the flaps (21, 31, 22, 32). This is advantageous for filling with biopharmaceutical fluid 7 of very large volumes (which could go up to 3000 liters and beyond), without generating folds in the faces W1, W2 which prevent reaching a target volume of biopharmaceutical fluid. Here, each triangular portion T11, T12 is formed by folding one of the wall elements 2 and 3 which is illustrated in FIG. 8B, by molding a portion of a flap of this wall element.

Figure 10:
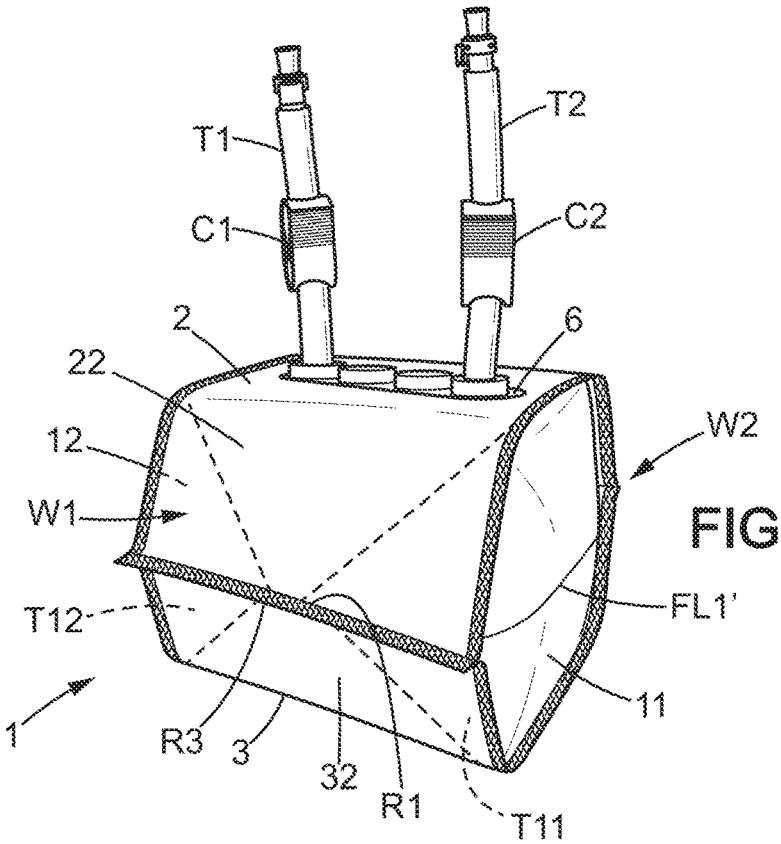
FIG. 10 is a perspective view of a 3-D flexible bag with an arrangement of the connection ports in a central zone of a wall element, between two flaps of this wall element.
Figure 11:
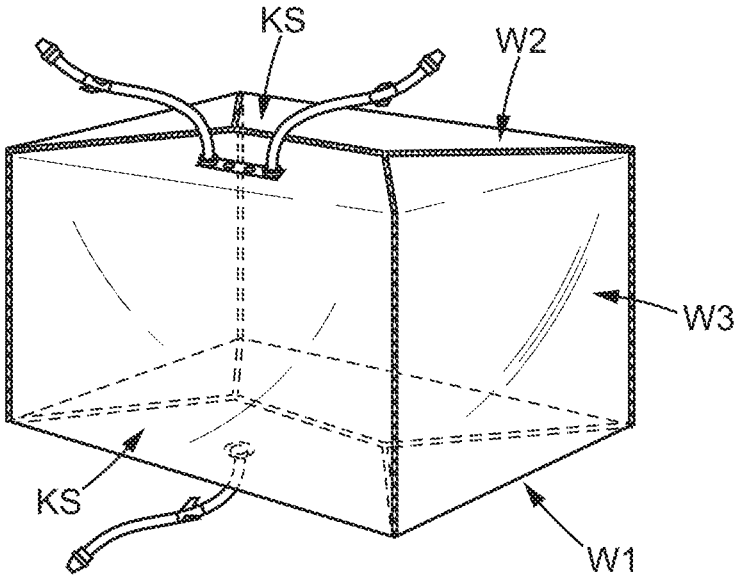
FIG. 11 is a perspective view of a 3-D flexible bag according to the prior art.

As can be seen in FIG. 10, under the face W1, four triangular portions T11 and T12 extend into one same plane along the flaps 22, 32 in the parallelepipedal configuration. Similarly, under the face W2, four triangular portions T11 and T12 also extend into one same plane along the flaps 21, 31 in the parallelepipedal configuration.

In the variants, the flexible bag 1 shown in FIG. 10 can have the same general configuration with different ports, for example to define a container of the collar type and making it possible for it to be stirred, as described in document EP 2 326 412 (see, in particular, FIGS. 1E to 1H and FIG. 2 in this document). Thus, the wall element 2 is found, which is placed typically on the top and supports the collar (the opposite can be provided with the wall element 2 on the bottom). It is thus observed, that also when the flexible bag 1 makes it possible for stirring/mixing applications, the port(s) is/are placed at a distance from the welds, on at least one of the wall elements 2, 3.

In the embodiments, the junction between the flaps 21, 31 and 22, 32 is the result of a local heating for a sufficiently long exposure period (which can be around 4 or 6 seconds or possible 10 seconds, for example) to heat or to heating by a low-voltage electrical impulse (for example up to 9 impulses), using a weld head. The heating technique by a low-voltage electrical impulse can be used such that the appearance of the visible face is unchanged, while guaranteeing a good weld quality: indeed, it does not require any high pressure at the time of the weld.

Impulse weld, thermal or laser weld techniques can make it possible to obtain resistant welds 140, 150. In the case of a thermal weld, it is preferable to simultaneously weld the four films by applying a pressure of between 4 and 8 bars between the weld blades or bars SB2. The heating of the weld blade on the outer film belonging to one of the wall elements 2, 3 (blade flattened with pressure of 6 bars, for example), is programmed to reach a target temperature, for example around 168° C. or 180° C. As a non-limiting example, the blades are heated to 168° C. and the blades are applied by keeping this temperature on the film for 4 s, then the blades are removed. There is no cooling period before moving the weld blades or bars SB2 from the film. The heating can start, substantially at the same time as obtaining contact with pressure on the zone to be welded.

These parameters are, of course, variable, according to the film and the thickness thereof. However, given that the thickness is typically broadly greater than 100 micrometers, it is preferably to provide an exposure duration of at least 2 or 3 seconds, the exposure duration being able to be between 3 and 6 seconds.

Of course, the target temperature can vary if necessary. It is preferred that this temperature is between 150° C. and 250° C. A target temperature between 165° C. and 190° C. can be preferred to advantageously reduce the heating duration (for example, to avoid exceeding 10 seconds), without risk of damaging the outer surface of a wall element 2, 3. Given the thickness of the films (thickness at least equal to 180 micrometers with several non-metal layers) and of the high resistance sought, the heating duration at the target temperature can here be at least 3 or 4 seconds.

Figure 4:
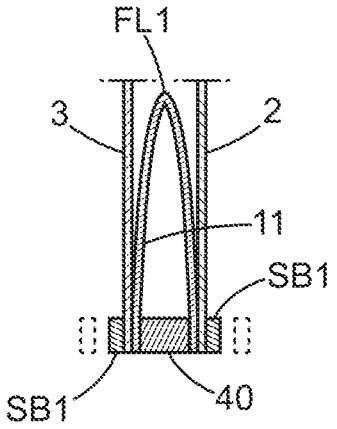
FIG. 4 is a detailed, cross-sectional view illustrating an example of a step of welding between a gusset and the adjacent wall elements of the 3-D flexible bag.

In the case of an impulse weld, the blades are applied on the film, then the heating is started. The increase in temperature is very quick (less than one second). The temperature of the blades can be brought to a target temperature of between 170° C. and 190° C., for example 180° C. This setpoint temperature is conserved for an exposure duration which could be between 6 seconds and 10 seconds, for example. An exposure duration of around 5 or 6 seconds or a little more, makes it possible to obtain the weld of four layers with a target temperature at 180° C. (without this value being limiting). Then, the blades are left to cool by simply stopping the heating (the current is cut), typically up to 80° C. or similar threshold. The cooling time can be less than or equal to 50 seconds, and for example between 15 or 20 seconds and 40 seconds. This cooling time can be reduced by using a cooling system of the weld blades (ventilation, circulation of a heat transfer fluid). Then, the weld blade or bars SB2 are moved to disconnect them from the film. In reference to FIGS. 3 to 6, an embodiment example of the blade welds SL can be seen, which are formed along a longitudinal direction (longitudinal scrolling course or direction DD of the film strips) during the production of flexible bags 1. On the production line, the insertion of the gussets 11 and 12 can be done in a manner known per se (see in FIG. 3, the step 50 of supplying and making available films 102, 103, 111 and 112, and the step 51 of folding the films 111, 112 towards the inside, intended to form the gussets 11, 12). To weld each gusset 11, 12, the corresponding film 111, 112 can be kept bearing against a guide having been used for folding or against an equivalent stop element 40 (FIG. 4).

The step 50 of supplying and making available four films 102, 103, 111 and 112 is typically made possible by using rollers (not represented) which unwind these films in one same general direction, called longitudinal scrolling direction DD. Of course, this direction is used simply as a reference point to explain the drawings and it is made possible, of course, to convey the films with one or more direction changes (no need for the transport direction to correspond to a straight-lined route).

It is understood, that the films 102, 103, 111 and 112, which respectively constitute the first wall element 2, the second wall element 3, the first gusset 11 and second gusset 12, are here welded by defining together, in the flat configuration, a total of six welds, of which:

- two weld zones (welds 140, 150) formed at the two opposite ends 14, 15 and which extend along a transverse direction; and
- four weld zones, perpendicular to the transverse direction, to form the side welds SL (which therefore extend parallel to the longitudinal scrolling direction DD).

Figure 5:
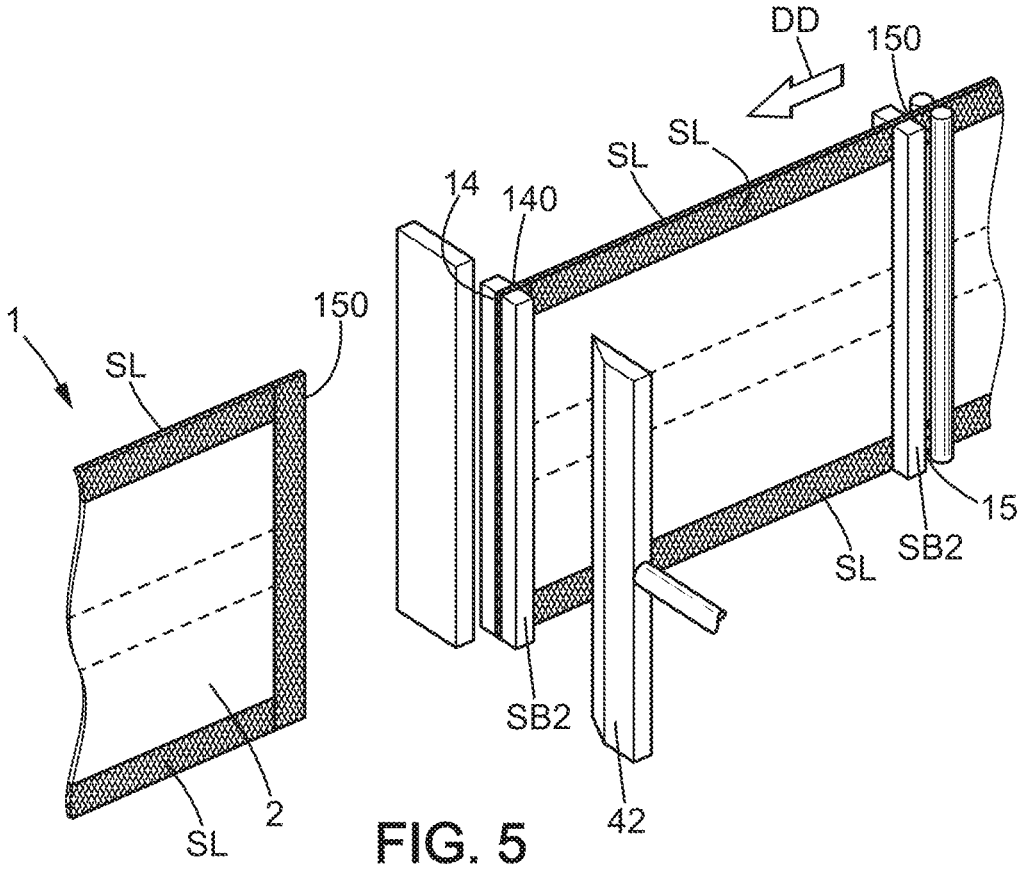
FIG. 5 is a perspective view illustrating an embodiment example of two continuous welds to obtain a flexible bag according to the first embodiment.

In reference to FIG. 5, it can be seen that the six welds SL, 140, 150 are continuous and not weakened by an opening or frangible zones. The width of each of these welds SL, 140, 150 can be at least equal to 5 mm in order to minimize the risk of leakage by an accidental impact.

At least along the weld zones and in the six welds SL, 140, 150, the thickness of each of the films 102, 103, 111 and 112 is not reduced with respect to the thickness E of said films in the elongate zones of the welds, the thickness E of these films 102, 103, 111 and 112 being typically constant. There is no frangible zone or other weakened region to make it possible for an opening.

As a non-limiting example, the thickness E (FIG. 12) is a constant thickness or possibly an average thickness and can be between 90 and 450 μm for each of these films 102, 103, 111 and 112.

As illustrated by the non-limiting example of FIG. 3, the four side welds SL can be simultaneously done during a weld step 52 which makes it possible to assemble the four films 102 and 103 (first pair of films opposite one another), 111 and 112 (second pair of films opposite one another and conveyed transversally with respect to the first pair of films). The pair of films 102 and 103 makes it possible to form, after a cutting step 53, the respective wall elements 2 and 3, while the pair of films 111 and 112 makes it possible to form, after the cutting step 53, the first gusset 11 and the second gusset 12.

The cutting step 53 can be optional. The material of the four films 102, 103, 111, 112 is identical here. More generally, it is understood that the first wall element 2, the second wall element 3, the first gusset 11 and the second gusset 12 are defined by rectangular sheets optionally having one same multilayer structure, with a layer defining an inner face suitable for contact with a biopharmaceutical fluid 7.

In reference to FIG. 4, a pair of weld bars SB1 or similar elements of a weld unit, arranged along a longitudinal direction on a production line, bearing against the outside (against the stop element 40) on the side edges 8, 9, 18, 19 of the wall elements 2 and 3 and make it possible to produce the side welds SL, here by thermal conduction for a brief moment (method also called impulse welding). The heating duration by conduction can be less than or equal to 4 or 6 s, given the increased temperature, and typically greater than 150° C., preferably without exceeding 200° C. for the threshold, greater than the actual range of temperature of the weld bars SB1. Thus, weld step 52 is carried out by continuously welding the longitudinal edges of the gussets 11 and 12 against the side edges 8, 18, 9, 19. Side welds SL are done, which extend from one another from the first and second ends 14, 15, as illustrated in particular in FIG. 5.

Although FIG. 5 illustrates the case of a continuous weld, made for example by impulse, just before a cutting step by a blade of a cutting member 42 which extends transversally with respect to the longitudinal scrolling direction DD, a different order of steps can also be provided, and/or product the cut at another moment. It can also be provided to produce the cuts or precuts before transverse welds 140, 150.

Moreover, it is understood that all the weld steps are carried out without prior introduction of material, contained such that a biopharmaceutical fluid 7, between the four constitutive elements 2, 3, 11 and 12 of the flexible bag 1.

In preferred applications, a filling of the flexible bag 1 of 3-D type can only be done after the complete sealing of the flexible bag 1 and to the formation of the connection port(s) 4, 6. It is understood, that the sealed closing system(s) C1, C2 can be connected, from the design, to the connection ports 4, 6, in order to avoid any air entering the flexible bag 1. Thus, the flexible bag 1 can be proposed empty, without the least orifice letting ambient air enter or, in a variant, systematically with the connection ports which form an inlet for the biopharmaceutical fluid and an outlet (placed on the same side as the inlet) to expel air. This is particularly advantageous for keeping a biopharmaceutical fluid 7 in a sterile state. The flexible bags 1, of 3-D type, shown in FIGS. 2, 8A, 9 and 10 make it possible for such a keeping in a sterile state. Preferably, the two opposite ends 14, 15 are designs identically.

In the embodiment variant that can be seen in FIG. 9, the flexible bag 1 only has one continuous weld 150 as wide as the wall elements 2 and 3 to form the face W1 is broken down into two flaps 22 and 33. The face W2' is differentiated here from the face W1 in that the wall elements 2, 3 have been narrowed in width and the junction between the four elements 2, 3, 11, 12 constituting the flexible bag 1 is the result of a K-shaped weld. The advantages of robustness and improved guiding during filling are obtained on the side of the face W1 which is here, a lower face and which has a connection port 4 on which is mounted sealed a flexible pipe 5 to empty the bag.

FIG. 5 shows an embodiment example of the welds 140 and 150, formed transversally in this type of process, here before a cutting step to separate two adjacent bags. The continuous welds 140 and 150 are done after the side welds SL to complete the sealing of the flexible bag 1, of 3-D type. The weld bars SB2 or similar elements are distributed on either side of the scrolling plane of the bags to locally heat the outer surface of the opposite wall elements 2, 3. With a system which has four weld bars SB2, it is made possible to simultaneously weld the rims formed at the ends 14 and 15, by forming continuous welds 140 and 150 which are as wide as the flexible bags 1, of 3-D type, in the flat configuration.

To obtain the bags of FIGS. 1A-1B and 2, this heating has been made in the zone for covering the edge portions 11*a* and 12*a* of the two gussets 11, 12 (in order to form the weld 150) and also in the zone for covering the other edge portions 11*b* and 12*b* (in order to form the weld 140). The flexible bag 1 is closed hermetically on the four sides thereof when it is located in the flat configuration, access to the inside of the bag 1 only being made possible by the connection ports 4, 6 which are formed in a later step (which can make it possible to vary the position and/or the size of the connection ports 4, 6, according to the biopharmaceutical application desired for the bag).

Contrary to what is required to form a K-shaped weld, with the need to accumulate a weld step in the transverse direction on the production line and two angled welds followed by a step for cutting angles, the production method is here advantageously simplified with a last simple cutting step which is carried out through the longitudinal scrolling direction DD of the bags, as can be seen in FIG. 5. Optionally, one single cutting member 42 can make all the transverse cuts.

FIGS. 8B and 8C only illustrate one part of each continuous weld 140, 150, which makes it possible to extend the first gusset 11 between the ends 14 and 14 without generating torsion during filling in:

- the region R1 for connection between the folding line FL1 and the continuous weld 140; and
- the region R2 for connection between the folding line FL1 and the continuous weld 150.

Of course, the same arrangement is provided for the connection of the folding line FL2 to the continuous welds 140, 150, such that the torsion tendency is minimized in:

- the region R3 for connection (that can be seen in FIGS. 1B and 10) between the folding line FL2 and the continuous weld 140; and
- the region R4 for connection (that can be seen in FIGS. 1B and 9) between the folding line FL2 and the continuous weld 150.

FIGS. 1A-1B and 2 show that the continuous weld 140, 150 extends over the whole of the width L2 of the respective wall elements 2 and 3. The perimeter defined by these elements 2 and 3 is generally rectangular, possible square, in the flat configuration. More generally, each continuous weld 140, 150 has a length which coincides with an outer dimension (measured in the same direction) of the wall elements 2, 3, both in the flat configuration of the flexible bag and in the parallelepipedal configuration.

In reference to FIG. 2, the distance between the opposite ends 14, 15 which have welds 140, 150 is typically a length L1 (length common to the wall elements 2, 3 and to the gussets 11, 12) which exceeds the width L2 defined by the two wall elements 2 and 3. Furthermore, the following ratio is typically satisfied:

$$0.05<D2/L2/<0.5$$

where D2 means a transverse space (minimum distance) between the first gusset and the second gusset, measured along the transverse direction (same direction as for the measurement of the width L2).

In reference to FIGS. 2 and 8A, the filling leads to the formation of the front 2*a* and rear 3*a* faces. In the parallelepipedal configuration, the flexible bag 1 thus has a common height which corresponds to the height of the front 2*a* and rear 3*a* faces. To form the lateral wall W3, the front face 2*a* and the rear face 3*a* are connected by two other faces defined by the unfolding of the gussets 11, 12 (with the formation of the section FL1' of a side and of a similar section of the other side). These two other faces are each delimited by a pair of longitudinal edges of the gussets 11, 12. A first longitudinal edge of the first gusset 11, continuously welded, are U-shaped and forms, by symmetry with a second longitudinal edge of the second gusset 12, also continuously welded and U-shaped, a rectangular delimitation of a first face F1 (FIG. 8A, face F1 defined by the first gusset 11) of the lateral wall W3, which connects the front face 2*a* to the rear face 3*a*.

A second intermediate face (defined by the second gusset 12) is also formed in the same manner and extends parallel to the first face F1 in the parallelepipedal configuration. It can be noted, that the longitudinal axis A belongs to a virtual median plane, perpendicular to the base of the U-shape, such that the U-shaped longitudinal edge has two symmetrical halves with respect to this median plane.

The U-shape of the longitudinal edges has the advantage of a better guiding of the expansion of the gussets 11, 12, with respect to what is produced with a conventional K-shaped weld. In addition, the substantially right angle which is formed between the "U-shaped" arms formed by the longitudinal edges and the "U-shaped" base avoids, at the side welds SL, the torsion effects met with a K-shaped weld which weaken the sealing in the angles of the corresponding faces. While the triangular portions T11 and T12 have a right angle (of 90°) at the junction of the corresponding side weld SL and of the continuous weld 140 or 150, the two other angles can be preferably between 30° and 60°.

In order to improve the mechanical resistance of the flexible bag 1, each of the films 102, 103, 111, 112 can have a set 17 of functional layers superposed on a contact layer 16. In reference to FIG. 12, an outer face made of PET can be provided, thanks to the outer layer 17*c*. This material which typically has a semi-crystalline confers a good resistance to oxygen in air (chemical resistance), a low water absorption rate and thus makes it possible for long-term storage applications. The thickness of the outer layer 17*c* can be particularly low, for example between 7 and 50 μm, preferably between 10 and 30 μm. In a variant, a linear high-density polyethylene can be provided, or other thermoplastics (in particular polyamide) which are easily weldable and sufficiently hard to improve the resistance of the assembly.

The contact layer 16 can consist of a layer of material, compatible with biological materials without any deterioration effect. Polyethylene, in particular linear low-density polyethylene, is an example of preferred material to constitute the contact layer 16, as it accumulates the advantages of compatibility with the biopharmaceutical fluid 7 and of good weldability. Other materials with similar properties can be used, for example, ethylene vinyl acetate copolymer.

An intermediate layer 17*a* can correspond to the layer with a barrier effect to gases (particularly to dioxygen and carbon dioxide present in ambient air). In certain options, one or two layers of binding material (adhesive layers) can be provided on one side and/or the other of the layer with a barrier effect.

Another intermediate layer 17*b* can consist of polyamide (PA), which improves the resistance to impacts (mechanical resistance). Here, as a non-limiting example, the intermediate layer 17*b* for mechanical resistance is placed between the outer layer 17*c* and the layer 17*a* with a barrier effect to gases. Because of the least resistance of the layer 17*a* with a barrier effect to gases, this can be placed advantageously between the contact layer 16 and the other layers 1*b*, 17*c* of the assembly 17. The composition of the multilayer film represented in FIG. 12 can be used for all the films 102, 103, 111, 112 of the flexible bag 1, of 3-D type. Such a composition can make it possible to limit the thickness E at least of 450 μm, for example around 200 or 400+/−50 μm. The thickness can possibly be reduced to around 100+/−30 μm, for example for application without hermetic closing of the flexible bag.

In a variant, only three layers can be used, and define an assembly 17 in two layers with more flexibility. For this, the layers 17*b* and 17C are replaced by a simple polyethylene layer, preferably linear low-density polyethylene. In this case, it is preferably to define a thicker contact layer 16 than in the example illustrated, such that the thickness E is around 400+/−50 μm, as a non-limiting example. The material of the contact layer 16 can also be made of linear low-density polyethylene.

The films preferably have three layers and have a resistance to traction, typically greater than 60 or 80 Newtons. This resistance to traction can generally be between 60 and 220 Newtons. The flexible bag 1 is thus particularly difficult to damage.

The extension to breaking, which defines the capacity of each of the films to be extended before breaking (in response to a traction test), is for example greater than or equal to 80%, but less than or equal to 400% or 500%. It is understood, that the flexible bag has physical and mechanical properties, suitable for the expansion from a folded-flat state to a parallelepipedal expanded state, which remove, in practice, the risk of accidental tearing.

One of the advantages of the flexible bag 1, of 3-D type, is the robustness thereof, in particular in the corners which are reinforced and in the transverse welds, for an obtaining method which limits the number of welding and cutting steps. The production method is more easily automatable to make it possible to increase the production rate. In addition, the fragilities due to the precision of the positioning of the welds at the junctions between the side weld and the angle welds which must be perfectly located facing the folds of the gussets to obtain a perfect K-shaped weld (the least fragile possible) are removed.

The expansion is facilitated for filling thanks to a guiding effect generated by the continuous weld(s) 140, 150, even if the films 102, 103, 111, 112 have a reduced flexibility (this reduced flexibility corresponding for example to a desire to increase the longevity and/or the mechanical properties of the flexible bag 1, of 3-D type).

The invention claimed is:

1. Method for producing a 3-D flexible bag to be filled with a biopharmaceutical product, the method comprising:

transversely cutting a first wall element relative to a longitudinal scrolling direction of a first roll, such that the first wall element is provided with two side edges consisting of a flexible film defining a front face, transversely cutting a second wall element relative to a longitudinal scrolling direction of a second roll, such that the second wall element is provided with two side edges, consisting of a flexible film defining a rear face, transversely cutting a first gusset and a second gusset relative to a longitudinal scrolling direction of at least a third roll, such that the first gusset and the second gusset are constituted by a flexible film delimited by two longitudinal edges, inserting the first gusset and the second gusset in a folded-in-two state around a longitudinal folding line, between the first wall element and the second wall element, the first gusset and the second gusset being arranged with a transverse space therebetween;

longitudinally welding the two longitudinal edges of the first gusset to the first wall element and to the second wall element, respectively to one of the side edges of the first wall element and of the second wall element to form two first side welds;

longitudinally welding the two longitudinal edges of the second gusset to the first wall element and to the second wall element, respectively to the other of the side edges of the first wall element and of the second wall element to form two second side welds;

transversally welding the first wall element and the second wall element to form two opposite welded end rims, by sandwiching between the first wall element and the second wall element, respectively two layers of the first gusset folded in two and two layers of the second gusset folded in two, such that the first gusset and the second gusset are also welded in the two opposite end rims, perpendicularly to the longitudinal edges thereof in a flat, empty configuration of the flexible bag, longitudinal folding lines extend between two opposite ends of the flexible bag in the flat, empty configuration, such that the first gusset and the second gusset make it possible for the flexible bag to be expanded from the flat, empty configuration to a substantially parallelepipedal configuration in a filled state, each end rim of the two opposite welded end rims being continuously welded along a length thereof and defining an outer dimension of the flexible bag which is common to the rear face and to the front face in the parallelepipedal configuration;

inserting, exclusively in the first wall element or the second wall element, a connection port making it possible to connect a flexible supply duct;

the first wall element, the second wall element, the first gusset and the second gusset having a resistance to traction of between 60 and 220 Newtons.

2. Production method according to claim 1, wherein the two opposite end rims are parallel, and are welded to define the same outer dimension of the flexible bag, the first wall element and the second wall element having a rectangular perimeter in the flat configuration.

3. Production method according to claim 1, wherein the first wall element, the second wall element, the first gusset and the second gusset are defined by rectangular sheets having one same multilayer structure.

4. Production method according to claims wherein the first side welds are continuously parallel to the second side welds between the two opposite end rims.

* * * * *